US009107245B2

(12) United States Patent
Bazzani et al.

(10) Patent No.: US 9,107,245 B2
(45) Date of Patent: Aug. 11, 2015

(54) HIGH ACCURACY, HIGH DYNAMIC RANGE LED/LASER DRIVER

(75) Inventors: Cristiano Bazzani, Irvine, CA (US); Fabio Gozzini, Newport Beach, CA (US); Tao Chen, Irvine, CA (US)

(73) Assignee: Mindspeed Technologies, Inc., Newport Beach, CA (US)

( * ) Notice: Subject to any disclaimer, the term of this patent is extended or adjusted under 35 U.S.C. 154(b) by 229 days.

(21) Appl. No.: 13/492,841

(22) Filed: Jun. 9, 2012

(65) Prior Publication Data

US 2013/0147393 A1 Jun. 13, 2013

Related U.S. Application Data

(60) Provisional application No. 61/495,320, filed on Jun. 9, 2011.

(51) Int. Cl.
*H05B 37/02* (2006.01)
*H05B 33/08* (2006.01)

(52) U.S. Cl.
CPC ..... *H05B 37/02* (2013.01); *H05B 33/0851* (2013.01)

(58) Field of Classification Search
USPC ..... 315/307, 291, 308, 224
See application file for complete search history.

(56) References Cited

U.S. PATENT DOCUMENTS

| | | | |
|---|---|---|---|
| 4,534,064 | A | 8/1985 | Giacometti et al. |
| 4,545,078 | A | 10/1985 | Wiedeburg |
| 4,687,927 | A | 8/1987 | Iwamoto et al. |
| 4,734,914 | A | 3/1988 | Yoshikawa |
| 4,747,091 | A | 5/1988 | Doi |
| 4,864,649 | A | 9/1989 | Tajima et al. |
| 5,019,769 | A | 5/1991 | Levinson |
| 5,039,194 | A | 8/1991 | Block et al. |
| 5,057,932 | A | 10/1991 | Lang |
| 5,334,826 | A | 8/1994 | Sato et al. |
| 5,383,046 | A | 1/1995 | Tomofuji et al. |
| 5,383,208 | A | 1/1995 | Queniat et al. |

(Continued)

FOREIGN PATENT DOCUMENTS

| | | |
|---|---|---|
| EP | 606161 | 4/2000 |
| EP | 1471671 | 12/2004 |

(Continued)

OTHER PUBLICATIONS

Yuan, 2007, Springer, XVIII, pp. 20-21.*

(Continued)

*Primary Examiner* — Tung X Le
*Assistant Examiner* — Amy Yang
(74) *Attorney, Agent, or Firm* — Weide & Miller, Ltd.

(57) ABSTRACT

A current driver circuit, for driving a light source, that provides high accuracy and reduced power consumption is disclosed. The driver includes a digital to analog converter configured to receive a digital value representing a light intensity and convert the digital value to an analog current signal. A current mirror is configured to receive the analog current signal and create a current mirror output which is larger than the analog current signal based on a ratio of the current mirror. This results in a modified analog current signal. A light source receives the modified analog current signal, and responsive thereto generate a light signal such that the light signal has an intensity controlled by the digital value. One or more amplifiers are also part of the current driver and configured to increase response time and accuracy.

16 Claims, 5 Drawing Sheets

(56) References Cited

U.S. PATENT DOCUMENTS

| | | | |
|---|---|---|---|
| 5,392,273 | A | 2/1995 | Masaki et al. |
| 5,394,416 | A | 2/1995 | Ries |
| 5,396,059 | A | 3/1995 | Yeates |
| 5,448,629 | A | 9/1995 | Bosch et al. |
| 5,471,501 | A | 11/1995 | Parr et al. |
| 5,488,627 | A | 1/1996 | Hardin et al. |
| 5,491,548 | A | 2/1996 | Bell et al. |
| 5,510,924 | A | 4/1996 | Terui et al. |
| 5,532,471 | A | 7/1996 | Khorramabadi et al. |
| 5,557,437 | A | 9/1996 | Sakai et al. |
| 5,574,435 | A | 11/1996 | Mochizuki et al. |
| 5,594,748 | A | 1/1997 | Jabr |
| 5,636,254 | A | 6/1997 | Hase et al. |
| 5,673,282 | A | 9/1997 | Wurst |
| 5,710,660 | A | 1/1998 | Yamamoto et al. |
| 5,812,572 | A | 9/1998 | King et al. |
| 5,822,099 | A | 10/1998 | Takamatsu |
| 5,844,928 | A | 12/1998 | Shastri et al. |
| 5,900,959 | A | 5/1999 | Noda et al. |
| 5,926,303 | A | 7/1999 | Giebel et al. |
| 5,943,152 | A | 8/1999 | Mizrahi et al. |
| 5,953,690 | A | 9/1999 | Lemon et al. |
| 5,956,168 | A | 9/1999 | Levinson et al. |
| 5,978,393 | A | 11/1999 | Feldman et al. |
| 6,010,538 | A | 1/2000 | Sun et al. |
| 6,014,241 | A | 1/2000 | Winter et al. |
| 6,020,593 | A | 2/2000 | Chow et al. |
| 6,021,947 | A | 2/2000 | Swartz |
| 6,023,147 | A | 2/2000 | Cargin, Jr. et al. |
| 6,049,413 | A | 4/2000 | Taylor et al. |
| 6,064,501 | A | 5/2000 | Roberts et al. |
| 6,108,113 | A | 8/2000 | Fee |
| 6,111,687 | A | 8/2000 | Tammela |
| 6,115,113 | A | 9/2000 | Flockencier |
| H1881 | H | 10/2000 | Davis et al. |
| 6,160,647 | A | 12/2000 | Gilliland et al. |
| 6,175,434 | B1 | 1/2001 | Feng |
| 6,259,293 | B1 | 7/2001 | Hayase et al. |
| 6,262,781 | B1 | 7/2001 | Deter |
| 6,282,017 | B1 | 8/2001 | Kinopshita |
| 6,292,497 | B1 | 9/2001 | Nakano |
| 6,366,373 | B1 | 4/2002 | MacKinnon et al. |
| 6,423,963 | B1 | 7/2002 | Wu |
| 6,452,719 | B2 | 9/2002 | Kinoshita |
| 6,473,224 | B2 | 10/2002 | Dugan et al. |
| 6,494,370 | B1 | 12/2002 | Sanchez |
| 6,512,617 | B1 | 1/2003 | Tanji et al. |
| 6,535,187 | B1 | 3/2003 | Wood |
| 6,556,601 | B2 | 4/2003 | Nagata |
| 6,570,944 | B2 | 5/2003 | Best et al. |
| 6,580,328 | B2 | 6/2003 | Tan et al. |
| 6,661,940 | B2 | 12/2003 | Kim |
| 6,704,008 | B2 | 3/2004 | Naito et al. |
| 6,707,600 | B1 | 3/2004 | Dijaili et al. |
| 6,720,826 | B2 | 4/2004 | Yoon |
| 6,740,864 | B1 | 5/2004 | Dries |
| 6,801,555 | B1 | 10/2004 | Dijaili et al. |
| 6,828,857 | B2 | 12/2004 | Paillet et al. |
| 6,836,493 | B2 | 12/2004 | Mahowald et al. |
| 6,837,625 | B2 | 1/2005 | Schott et al. |
| 6,852,966 | B1 | 2/2005 | Douma et al. |
| 6,862,047 | B2 | 3/2005 | Hibi |
| 6,864,751 | B1 | 3/2005 | Schmidt et al. |
| 6,868,104 | B2 | 3/2005 | Stewart et al. |
| 6,879,217 | B2 | 4/2005 | Visocchi |
| 6,888,123 | B2 | 5/2005 | Douma et al. |
| 6,909,731 | B2 | 6/2005 | Lu |
| 6,934,307 | B2 | 8/2005 | DeCustatis et al. |
| 6,934,479 | B2 | 8/2005 | Sakamoto et al. |
| 6,941,077 | B2 | 9/2005 | Aronson et al. |
| 6,956,643 | B2 | 10/2005 | Farr et al. |
| 6,957,021 | B2 | 10/2005 | Aronson et al. |
| 6,967,320 | B2 | 11/2005 | Chieng et al. |
| 7,031,574 | B2 | 4/2006 | Huang et al. |
| 7,039,082 | B2 | 5/2006 | Stewart et al. |
| 7,046,721 | B2 | 5/2006 | Grohn |
| 7,049,759 | B2 | 5/2006 | Roach |
| 7,050,720 | B2 | 5/2006 | Aronson et al. |
| 7,058,310 | B2 | 6/2006 | Aronson et al. |
| 7,066,746 | B1 | 6/2006 | Togami et al. |
| 7,079,775 | B2 | 7/2006 | Aronson et al. |
| 7,184,671 | B2 | 2/2007 | Wang |
| 7,193,957 | B2 | 3/2007 | Masui et al. |
| 7,206,023 | B2 | 4/2007 | Belliveau |
| 7,215,891 | B1 | 5/2007 | Chiang et al. |
| 7,265,334 | B2 | 9/2007 | Draper et al. |
| 7,276,682 | B2 | 10/2007 | Draper et al. |
| 7,357,513 | B2 | 4/2008 | Watson et al. |
| 7,381,935 | B2 | 6/2008 | Sada et al. |
| 7,453,475 | B2 | 11/2008 | Nitta et al. |
| 7,504,610 | B2 | 3/2009 | Draper |
| 7,692,417 | B2 | 4/2010 | Dagher |
| 2001/0046243 | A1 | 11/2001 | Schie |
| 2002/0015305 | A1 | 2/2002 | Bornhorst et al. |
| 2002/0105982 | A1 | 8/2002 | Chin et al. |
| 2002/0130977 | A1 | 9/2002 | Hibi |
| 2002/0140378 | A1* | 10/2002 | Volk et al. ..... 315/291 |
| 2003/0030756 | A1 | 2/2003 | Kane et al. |
| 2003/0053003 | A1 | 3/2003 | Nishi et al. |
| 2004/0032890 | A1 | 2/2004 | Murata |
| 2004/0047635 | A1 | 3/2004 | Aronson et al. |
| 2004/0095976 | A1 | 5/2004 | Bowler et al. |
| 2004/0136727 | A1 | 7/2004 | Androni et al. |
| 2004/0202215 | A1 | 10/2004 | Fairgrieve |
| 2004/0240041 | A1 | 12/2004 | Tian et al. |
| 2005/0180280 | A1 | 8/2005 | Hoshino et al. |
| 2005/0185149 | A1 | 8/2005 | Lurkens et al. |
| 2006/0114954 | A1* | 6/2006 | Wong et al. ..... 372/38.04 |
| 2006/0192899 | A1 | 8/2006 | Ogita |
| 2007/0058089 | A1 | 3/2007 | Wang |
| 2007/0081130 | A1 | 4/2007 | May et al. |
| 2007/0159434 | A1* | 7/2007 | Yen et al. ..... 345/92 |
| 2007/0195208 | A1 | 8/2007 | Miyazawa et al. |
| 2007/0229718 | A1 | 10/2007 | Hall |
| 2007/0286609 | A1 | 12/2007 | Ikram et al. |
| 2008/0012508 | A1* | 1/2008 | Steele et al. ..... 315/306 |
| 2008/0024469 | A1 | 1/2008 | Damera-Venkata et al. |
| 2008/0074562 | A1 | 3/2008 | Endo et al. |
| 2008/0231209 | A1* | 9/2008 | Shiwaya et al. ..... 315/291 |
| 2008/0246893 | A1 | 10/2008 | Boss et al. |
| 2008/0303499 | A1 | 12/2008 | Chen et al. |
| 2008/0309407 | A1 | 12/2008 | Nakamura et al. |
| 2010/0164396 | A1* | 7/2010 | Lindeberg et al. ..... 315/291 |
| 2011/0062874 | A1* | 3/2011 | Knapp ..... 315/158 |

FOREIGN PATENT DOCUMENTS

| | | |
|---|---|---|
| JP | 2001-119250 | 4/2001 |
| JP | 2004-045989 | 2/2004 |
| WO | WO 93/21706 | 10/1993 |
| WO | WO 02/063800 | 8/2002 |
| WO | WO 2004/098100 | 11/2004 |

OTHER PUBLICATIONS

A Low Noise, Wide Dynamic Range, Transimpedance Amplifier with Automatic Gain Control for SDH/SONET (STM16/OC48) in a 30GHz ft BiCMOS Process, Mihai A. T., Sanduleanu, Philips Research Eindhoven, Paul Manteman, Philips Semiconductors Nijmegen, Sep. 19, 2001, 19 pages.

Garth Nash, "AN535 Application Notes-Phase-Locked Loop Design Fundamentals", Motorola, Inc., 1994, 3 pages.

Jamie Bailey "How DVD Works", http://sweb.uky.edu/~jrbai101/dvd.htm, May 1, 1999, pages.

Tuan "Solace" Nguyen, "CD, CD-R, CD-RW, DVD, DD-RAM, DVD-RW, and MO", Tweak3D.Net-Your Freakin' Tweakin Source!, http://www.tweak3d.net/articles/opticals/, May 13, 2000, 7 pages.

"An Introduction to DVD-RW", DVD White Paper, Pioneer New Media Technologies, Inc., Feb. 8, 2001, 8 pages.

Ron Bertrand, "The Basics of PLL Frequency Synthesis", Online Radio & Electronics Course, Apr. 2002, 9 pages.

Richard Wilkinson "Topic: Selecting the Right DVD Mastering

(56) References Cited

OTHER PUBLICATIONS

Technique", DVD Technology Update, http://www.optical-disc.com/dvdupdate.html, 2002, 8 pages.
Dr. John Rilum, "Mastering Beyond DVD Density", http://www.optical-disc.com/beyonddvd.html, 2002, 7 pages.
"CD Basics: The Bumps", Howstuffworks "How CD Burners Work", http://entertainment.howstuffworks.com/cd-burner1.htm, 2004, 3 pages.
Keith Szolusha, "Linear Technology Design Notes DC/DC Converter Drives Lumileds White LEDs from a Variety of Power Sources—Design Note 340", Linear Technology Corporation, © Linear Technology Corporation 2004, date unknown, 2 pages.
"An Introduction to DVD Recordable (DVD-R) What is DVD Recordable?" http://www.dvd-copy.com/reference/dvd_recordable.html, 2004, 8 pages.
"Power Management, LED-driver considerations" Analog and Mixed-Signal Products, Analog Applications Journal, www.ti.com/sc/analogapps, Texas Instruments Incorporated, © 2005 Texas Instruments Incorporated, Michael Day, 5 pages.
"Linear Technology LCT 3533 2A Wide Input Voltage Synchronous Buck-Boost DC/DC Converter", © Linear Technology Corporation 2007, 16 pages.
"National Semiconductor LM 3549 High Power Sequential LED Driver", © 2010 National Semiconductor Corporation, www.national.com, Aug. 3, 2010, 20 pages.
"TPS63020 TPS63021 High Efficiency Single Inductor Buck-Boost Converter With 4-A Switches", Texas Instruments, Copyright © 2010, Texas Instruments Incorporated, Apr. 2010, 28 pages.
"LT3476-High Current Quad Output LED Driver" Linear Technology, http://www.linear.com/product/LT3476, @2010 Linear Technology, 14 pages.
"Current mirror" Wikipedia, the free encyclopedia, http://en.wikipedia.org/wiki/Current_mirror, May 22, 2011, 8 pages.
"Mosfet"Wikipedia, the free encyclopedia, http://en.wikipedia.org/wiki/MOSFET, May 27, 2011, 24 pages.

* cited by examiner

HIGH ACCURACY, HIGH DYNAMIC RANGE LED/LASER DRIVER

PRIORITY CLAIM

This application claims priority to and the benefit of U.S. Provisional Patent Application No. 61/495,320 titled Low Power Multi Ampere Capable Fully Integrated High Accuracy, High Dynamic Range LED/LASER Driver filed on Jun. 9, 2011.

FIELD OF THE INVENTION

This invention relates to projection systems and in particular to a method and apparatus providing a low power, multi ampere capable, fully integrated, high accuracy, high dynamic range LED/LASER driver.

RELATED ART

The design of totally integrated LED/Laser drivers for portable solution is a challenging task for three main reasons. First, this application requires high current capability. Second, high accuracy is also required to compensate for both thermal and aging effect which occur and, if not compensated, will affect image quality and could inhibit operation. Third, it is preferred to have low power dissipation since projector systems often operate on battery power. In addition, reduced power consumption is typically associated with reduction in generated heat.

With regard to sourcing sufficient current to the light sources (laser/LED), existing portable projector systems require a multi ampere driver to generate sufficient current for the light sources to produce sufficient brightness. In addition, laser sources tend to produce much higher optical output for the same driving current when compared to LEDs therefore there is a need for a high dynamic range which can cover all applications, namely both LED's and lasers.

In addition, projection systems usually employ multiple light sources (typically 3: red, green and blue) to create the necessary colors for the images. Look-up tables are typically employed to adjust the drive current of each of these colored light sources to produce properly white balanced images and to adjust for temperature changes and light sources age. Hence the need for a stable, predictable and adjustable current source is required so that the current provided to the light source be adjusted in response to the aging and changes in temperature of the light source.

Since the typical impedance of a light source is low, (in the order of 1Ω), a power LASER/LED (light source) is commonly driven by using a current source, i.e. a saturated MOSFET and/or BJT. While use of a current source, i.e. a saturated MOSFET and/or BJT achieves acceptable accuracy, this configuration suffers from poor efficiency. By way of example and not limitation, to provide 2 amps to the light source, which may be required to drive the light source at the specified brightness output, a saturated MOSFET needs about 600 mV of headroom. This equates to 1.2 W of output power required only for the output stage. As can be appreciated, this is undesirably high power consumption, particularly if the device housing the light source receives power from a battery.

Other solutions for providing a current driver that meet these criteria utilize a fixed high power resistor, which is usually external. As would be understood by one of ordinary skill in the art, the use of a fixed external high power resistor is difficult to tune and not will allow for adjustability or driver current over time since programmable pots with high current capability are not readily available in the sizes required for integration in portable electronics devices.

Alternative solutions utilize external current setting resistors to set the current. These solutions feature internal circuitry to multiply the current up in magnitude. As a drawback however, the multiplication ratio is fixed and therefore to adjust the output current requires use of external programmable pots. This adds complexity, increases size, and increases costs. Moreover, resolution and dynamic range is usually limited by digital pot resolution.

The current driver disclosed below overcome these drawbacks and provides additional benefits.

SUMMARY

To overcome the drawbacks of the prior art and provide additional benefits, a current driver circuit is disclosed. In one embodiment the current driver circuit is configured to drive a light source and includes a digital to analog converter configured to receive a digital value representing a light intensity and convert the digital value to an analog current signal. The driver also includes a current mirror configured to receive the analog current signal and create a current mirror output which is equal to or larger than the analog current signal based on a ratio of the current mirror. This results in a modified analog current signal. A light source is provided and configured to receive the modified analog current signal, and responsive to the current mirror output generate a light signal, the light signal having an intensity controlled by the digital value.

In one configuration, the driver further comprises a balancing amplifier configured to balance drain nodes of devices within the current mirror. The driver may also include an amplifier connected between an output of the digital to analog converter and the current mirror to increase the rate of change or responsiveness of the current mirror output. In one configuration the driver also includes an amplifier having an input connected to receive the analog current signal and an output presenting an amplified analog current signal to the current mirror. A second amplifier may be provided. The second amplifier is configured to equalize the drain terminals of an input device and an output device in the current mirror to establish the drains of the input device and the output device at the same or generally the same voltage or current. A processor may be provided to generate or obtain the digital value from image data. The digital to analog converter may have a 10 bit resolution and a 6 bit range although other resolutions and ranges are contemplated.

Also disclosed is a method for establishing or generating a light signal having an intensity determined by a digital value. This exemplary method comprises receiving image data and processing the image data to determine the intensity. Also part of this method is generating a digital value representing the intensity, and processing the digital value to generate a first current that is proportional to the digital value. Thereafter, the method processes the first current to generate a second current such that the magnitude of the second current is greater than a magnitude of the first current, and presenting the second current to a light source. The method then generates the light signal with the light source such that the intensity of the light signal is proportional to the digital value.

The step of processing the digital value may be performed by a digital to analog converter. In addition, processing the first current to generate a second current may comprise using a current mirror to create the second current based on the first current. And, the current mirror may have a current mirror ratio of greater than 1:50 or greater than 1:200. In other embodiments other ratios may be established. This method may further include amplifying the first current and using the amplified first current to increase a speed of transitions to or between different second current magnitudes. In addition, this method may further comprise presenting the amplified first current to a gate node such that the gate node is formed as a connection point between two or more gate terminals in a current mirror.

Also disclosed herein is a current driver and light source. The current driver is configured to provide a drive current to a light source used in a projector system. In this configuration the current driver comprises a controlled current source configured to receive a digital control input from a processor to generate a first current. A current multiplier is configured to receive the first current and power from power source and responsive thereto, the current multiplier is configured to output a second current that is greater than the first current. Also part of this configuration is a light source that is configured to receive the second current and responsive to the second current, generate a light signal having an intensity based on the digital control input.

The current multiplier may comprise a current mirror. In one embodiment the current driver and light source may have an amplifier configured to amplify the first current and present the amplified first current to a gate node in the current mirror to increase responsiveness of the current driver. The current driver and light source may further include an amplifier and a transistor such that the amplifier has an output connected to a gate node of the transistor and first input configured to receive the second current and a second input configured to receive at least a portion of the first current so that the amplifier equalizes drain nodes of the current mirror. The controlled current source may comprise a digital to analog converter. The digital to analog converter may be a current source digital to analog converter. In one configuration the current driver and light source also includes a processor configured to generate or receive image data, which the processor uses to form the digital control input.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views

DETAILED DESCRIPTION

Figure 1A:
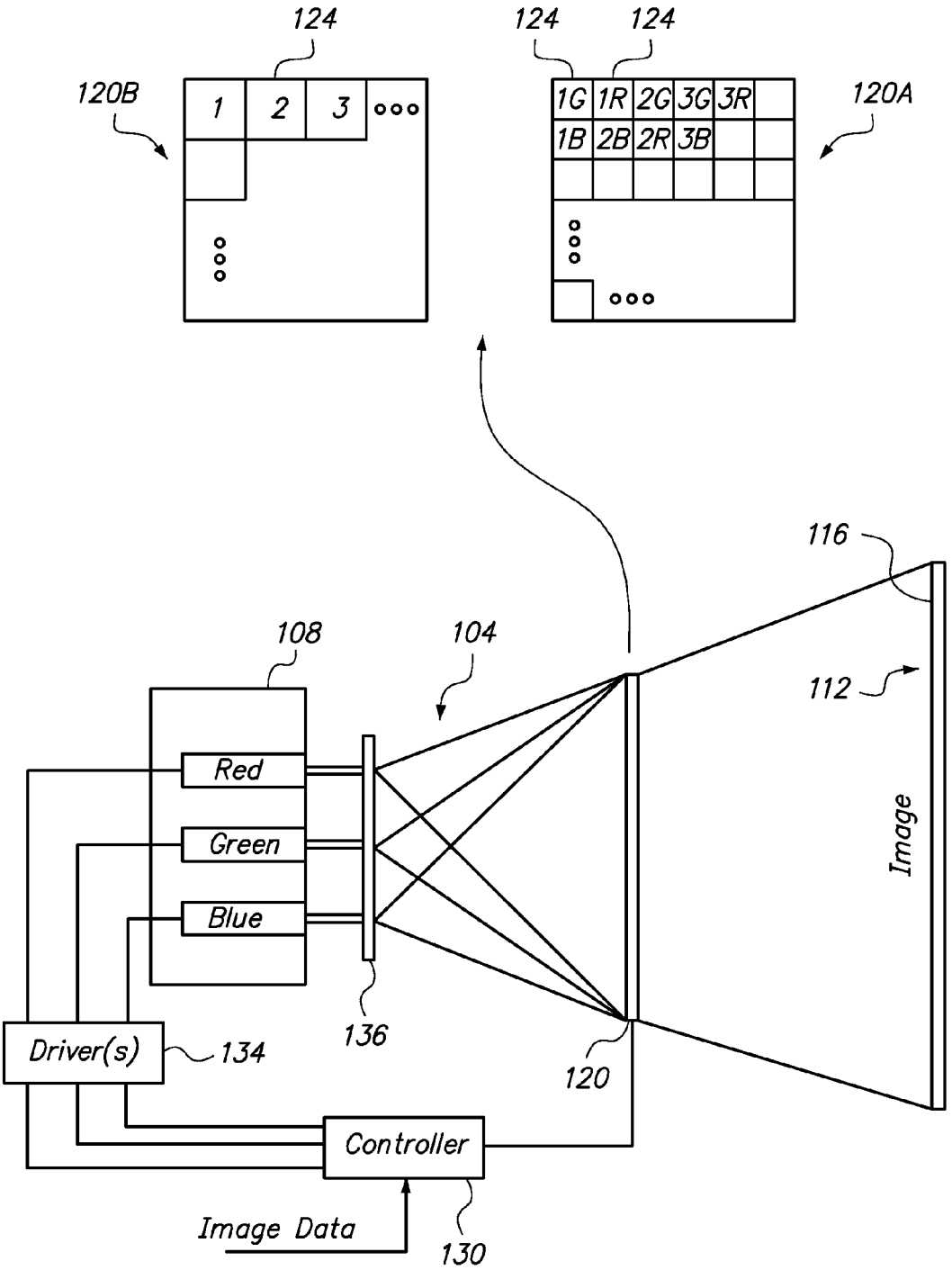
FIGS. 1A and 1B are block diagrams illustrating an example environment of use for the driver disclosed herein.
Figure 1B:
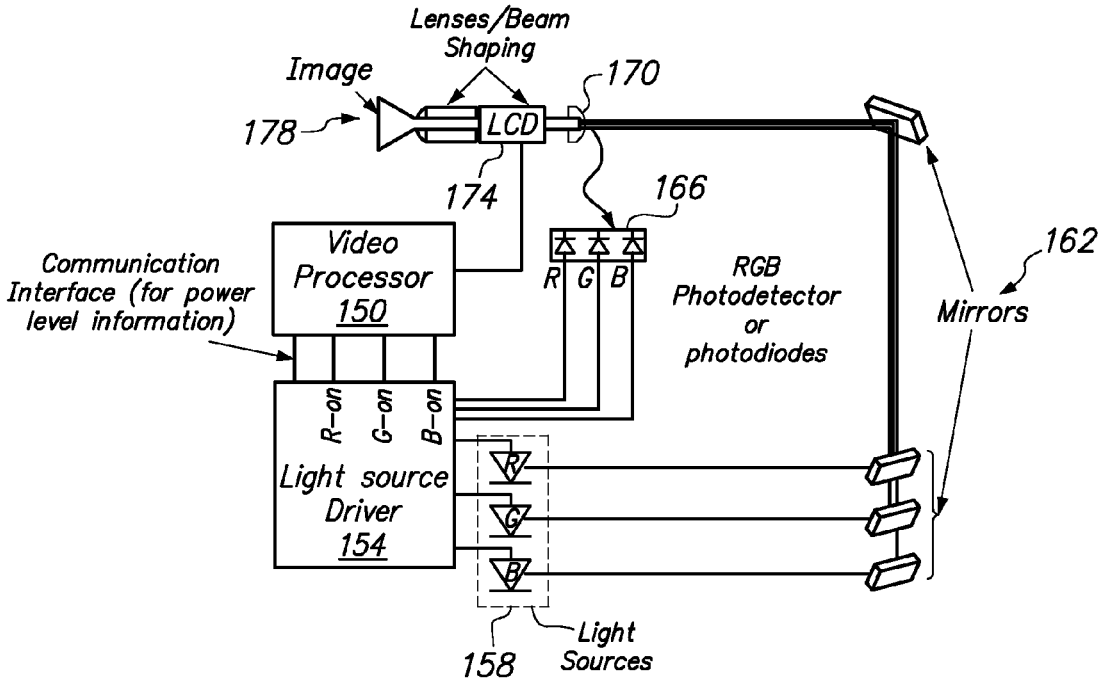

FIGS. 1A and 1B illustrate an example environment of use of the current driver disclosed herein. This but one possible environment of use. It is also contemplated that the current driver system as described herein may be used any other environment which would benefit from the feature set associated with this current driver. Alternative environments of use include but are not limited to laser printers, CD or DVD writers, or any other application having a light source.

In this example environment of a projector system, a light signal 104 is generated by 3 light sources 108, such as a red light source, green light source and blue light source. In other embodiments, different number or color of light sources may be utilized. The light sources 108 may comprise a laser, LED, combination thereof, or any other light source. The output of the light sources is provided to an optical system 136. In this embodiment, the optical system 136 comprises one or more lenses, mirrors, or both. The optical system 136 directs or focuses the light to a pixel matrix 120. The optical system 136 may be passive or active. The image 112 is created by shining on and filtering these colors through the pixel matrix 120. In one embodiment, the pixel matrix 120 is an LCD/LCoS system. In other embodiments the matrix can be a DLP engine. The pixel matrix 120 is a matrix of pixels 124 where each pixel can be made transparent or opaque to light, or some level of opaqueness between transparent and opaque. The projected image 112 is created by shining through or blocking (selectively for each pixel) the light from the light sources 108 to adjust the intensity of the light. The matrix 120 could also change or set the color of the light. The resulting image 112 may be projected onto a viewing screen 116. Multiple pixel matrixes (LCD/LCOs screens) may also be used in some embodiments (for example one per color).

In color sequential projection systems, the image is composed with overlapping monochromatic images (usually RED, GREEN and BLUE generated by 3 separate light sources, typically LEDs or lasers). The light source may also be a white LED followed in the optical path by a color wheel however this is less common in portable systems due to the size and the potential unreliability of the color wheel. Therefore, color accuracy and accurate intensity control is important.

As discussed above, the projected image is obtained by shining the light onto the pixilation engine (either a LCoS, LCD or DLP matrix) at a frequency higher than the speed of the human eye in such a way that the still image appears as a single uniform image, and the movement in a video image masks any possible the transitions between colors. Often the color saturation obtained with overlapping images is higher than what is required by the application or what the video source is capable of offering so to increase overall brightness, color mixing or color de-saturation is used where each of the overlapped images in not purely monochromatic (single monochromatic light source on) but a primary color is present and other are "mixed-in" by turning on one or more additional LED/laser.

A controller 130 provides control signals or a low power output signal to one or more drivers 134. The drivers 134 in this example environment of use may benefit from the current driver configuration shown in FIGS. 2 and 3. The one or more drivers 134 amplify the signal(s) from the controller 130 to a level suitable to power or drive the light sources 108. The controller 130 also connects to the pixel matrix 120 to provide one or more control signals to these devices to control when and to what degree the pixels in the pixel matrix pass or block light. In this example embodiment, the controller 130 receives image data although in other embodiments it contemplated that other type data may be sent to the controller. The one or more control signals are sent to the pixel matrix 120 to control the opaqueness of each pixel during different time periods and/or frames. The term opaqueness is defined to the mean the amount of light which is allowed to pass through a pixel 124 in the pixel matrix 120.

It is contemplated that the pixel may be clear, allowing 100% of the light to pass through (disregarding possible losses in the matrix itself), or opaque, allowing none (or very little) of the light to pass through, or any level of opaqueness there between to allow varying levels of light to pass through each pixel 124 of the pixel matrix 120.

The one or more control signals to the light sources 108 may control the intensity, duration, or other factor regarding the light emitted from the one or more light sources. It should be noted that in this example embodiment, the light sources are not on all at the same time and as such each of the three light sources is on for one third of the duration of a frame. The slow reaction time of the human eye, in relation to system operation, is such that each frame is perceived in full color even though the colors (light sources) are turned on in sequence, which may be referred to as time multiplexed.

Similar principles as described herein may be applied to a scanning system. The following discusses laser, or any light source, projection systems which scan the image and it is hereby incorporated by reference in its entirety herein: Application Publication Number 20080055557 entitled Method and Apparatus for Controllably Modulating a Laser in a Laser Projection Display. This publication discusses a scanning type projection system.

At the top of FIG. 1A are two example pixel matrixes 120A and 120B, either of which could be utilized. These exemplary pixel matrixes are in the light path between the light sources 108 and the screen 116. In the pixel matrix 120 shown at the top of FIG. 1A, the part 120 has been rotated 90 degrees to aid in understanding of the pixel screen. In this example embodiment intended for purposes of discussion, the pixels 124 in the pixel matrix which correspond to the first pixel on the viewable image 112 are labeled '1'. The pixels for the second pixel on the viewable image 112 are labeled '2'. As can be appreciated, in this embodiment, the pixel matrix 120A has three pixels 124 for each pixel in the viewable image. In this embodiment, each pixel 124 is assigned to a light source color, such as red, green and blue and is thus controlled during the time period when that light source is emitting light. At other times, it may be opaque, to hinder or prevent light from passing through.

In one embodiment, as shown in pixel matrix 120B, there is a one to one correspondence between the pixels on the pixel matrix 120 and the pixels of the image 112. Each pixel 124 is separately controlled for each period of the frame. For example, if the frame time is divided into 3 time windows, one window for each of Red, Green, Blue, then the opaqueness of each pixel 124 would likely be different during each of the three time windows depending on the intensity and color for that pixel for the frame. As such, the opaqueness of each pixel's opaqueness is controlled for each color during the frame to allow the desired amount of light of each color to pass. The eye will tend to blend this light to create the actual desired color, particularly if light source modulation occurs quickly. It is contemplated that other methods of selectively allowing light to pass through the pixel matrix 120 may be developed which do not depart from the claims.

FIG. 1B illustrates an alternative embodiment of the light source and pixel matrix controller. This is but one example possible environment of use. In this embodiment a video processor 150 generates, processes, or receives image data which is used to create an image. The video processor 150 outputs the image data to a light source driver 154 as shown. In this embodiment, the transfer occurs over a communication interface that includes power level information. The light source driver 154 also receives a feedback input from a photodetector 166, which is discussed below in more detail.

The light source driver 154 outputs drive signals to light sources 158 as shown. In this embodiment, there are three light sources tuned to red, green, and blue colors. In other embodiments, more or fewer light sources may be utilized. The lights sources 158 generate light output, which is directed to one or more mirrors 162 as shown, or directly to lenses or beam shaping apparatus. Although shown in a common cathode configuration, it is contemplated that the driver(s) 154 or light sources 158 could be arranged in a common anode configuration.

The lenses or beam shapers 170 focus the light from the mirrors 162 through an LCD 174 or other light intensity control unit. Light passing through an LCD 174 may pass through additional lenses or beam shapers 170 before forming an image 178. Other embodiment may not include the mirrors, which are optional.

It is contemplated that the lenses or beam shapers 170 may direct a portion of the light to the photodetector 166. The photodetector 166 converts the light energy to a corresponding electrical signal to thereby provide a closed loop feedback to the light source driver 154 as shown or the video processor 150. It is contemplated that the embodiments of FIGS. 1A and 1B may be configured to process images or video.

In a battery operated system or in general in systems where power dissipation is important, usually the voltage across the light source is regulated by a DC-DC converter so that the current required for the specific light output flows into the laser/LED at the minimum possible voltage required by the LED/laser for that particular current therefore minimizing overall power dissipation.

Figure 2:
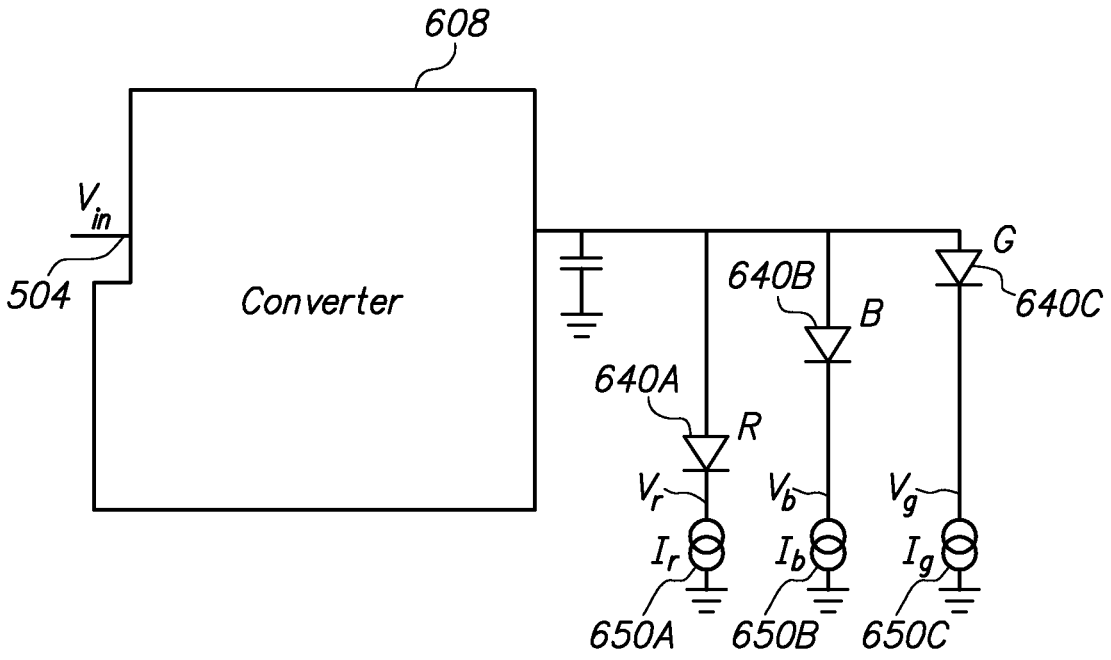
FIG. 2 illustrates an example embodiment showing circuit level detail including current drivers in a projector system.

FIG. 2 illustrates an example embodiment showing circuit level detail of a projector system. As shown, a DC-DC converter 608 is provided which receives an input voltage $V_{in}$ on input 504.

A single output of the DC-DC converter 608 connects to each of the light sources 640A, 640B, 640C. Thus, each light source receives the same DC-DC converter output signal. Connected to the opposite terminal of the light source 640 is a current source driver 650A, 650B, 650C. The drivers 650 may correspond to the driver shown and described in FIG. 3. A control signal (not shown) is provided to the current source drivers 650 to control the voltage levels for $V_r$, $V_b$, $V_g$ and these voltage levels are determined by which light source is the active or full power light source in the time multiplexed image generation arrangement.

In the embodiment of FIG. 2, all three light sources 640 share the same single output of the DC-DC converter 608. While this configuration does allow the light sources to operate concurrently in a color mixing scheme, only one of the cathode voltage, ($V_r$, $V_b$, or $V_g$) can be adjusted at a time. All of the anodes of the light sources must share the same signal from the DC-DC converter 608. In other embodiment a converter 608 may be associated with each light source.

Depending on the light engine, including light sources, used and the supply used for the system (single battery or multiple stacked battery) the type of converter used could be a buck only, a buck-boost or conceptually even a boost only (even thou other system considerations may prevent the use of a boost only).

Figure 3:
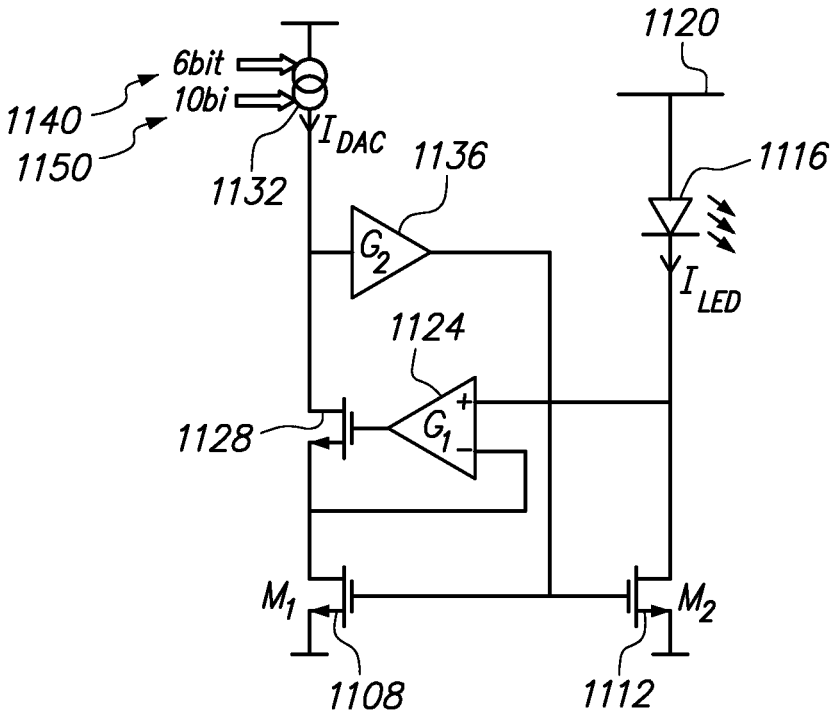
FIG. 3 illustrates an example embodiment of a high ampere current driver having high accuracy and high dynamic range.

To overcome the drawbacks of the prior art and those disclosed above, a light source driver is disclosed that is configured as shown in FIG. 3. This is but one possible circuit configuration and as such, one of ordinary skill in the art, after reading the following description and viewing the Figures may arrive at different circuit configurations which does not depart of the principles of this innovation and which does not depart from the claims that follow.

In this example embodiment, the driver design is based on a current mirror. The current mirror is regulated by an adjustable current source controlled by a multiplying digital to analog converter (DAC). This provides the benefit of adjustability and high output impedance, combined with a wide dynamic range.

The circuit of FIG. 3 is now discussed in detail. A current mirror is established by devices MOSFET M1 and M2 1108, 1112 which have gates connected as shown. It is contemplated that devices other than or in addition to metal oxide field effect transistors (MOSFET) may be used in the circuit or in another implementation. As to device M2 1112, its source is connected to ground or other reference value while its drain is connected to a light source 1116. Flowing through the light source 1116 is a current $I_{LED}$. In this embodiment, the anode of the light source 1116 is connected to a reference voltage 1120 which provides the necessary voltage bias to the light source 1116 and the required headroom to the driver. Although the driver of FIG. 3 is illustrated by an NFET/NPN configuration for common anode driving, it is also contemplated that the driver could be configured for PFET/PNP configuration for common cathode driving.

The other device M1 1108 of the current mirror M1, M2 has a drain connected to the source of a MOSFET device 1128. A differential amplifier G1 1124 has a negative input terminal connected to the drain of MOSFET M1 1108 while the positive input terminal of the differential amplifier G1 1124 connects to the drain of the MOSFET M2 1112. The output of the differential amplifier G1 1124 provides an input to the gate MOSFET 1128.

A second amplifier G2 1136 receives as an input the signal from the node established by the connection between the drain of MOSFET 1128 and the output of a digital analog converter (DAC) 1132. In one embodiment the DAC 1132 is a current DAC or current source DAC. To increase the speed of the circuit and transition between different current drive magnitudes, the gates of the input/output MOSFETs 1108, 1112 are actively driven by the operational amplifier G2 1136.

The DAC 1132 generates an output current proportional to the digital inputs 1140 and 1150. In this embodiment, the inputs comprise one or more digital input with a 10 bit resolution and a 6 bit adjustable full scale. In other embodiments other levels of resolution and range are possible. In one embodiment, the digital input 1140, 1150, which may be a single input having the specification set forth above, may be received from a processor, such as for example, processor 150 in FIG. 1B. In other embodiments, the digital input may arrive from other devices or elements, or an off IC location or a co-located controller.

In operation of this embodiment, the MOSFET devices M1 and M2 1108, 1112 in the output current mirror can be biased in both the linear or the saturation region depending on the $I_{DAC}$ current and the drain voltage. A digital value is presented to the DAC 1132 which converts the digital value to an analog current $I_{DAC}$. This digital value comprises the desired intensity of light output from the light source 1116. As the value presented to the DAC 1132 increases, the current $I_{DAC}$ likewise increases. In one example embodiment, the full scale current is 1 to 10 mA. In other embodiments the full scale current from the DAC 1132 may range between different values and have a different differential.

The $I_{DAC}$ current is then mirrored at a ratio established by the current mirror 1108, 1112 to the current mirror output current, $I_{LED}$, which in turn generates light output by the light source 1116. The required resolution and accuracy of the drive current $I_{LED}$ is achieved by biasing the driver's input with the DAC 1132, which in this embodiment features a 10 bit resolution and a 6 bit adjustable full scale current from 1 mA to 10 mA. In one configuration the DAC 1132 is a multiplying DAC that establishes a gain. When multiplied by a ratio of 1:200 (gain), the resulting output full scale current may range from 200 mA to 2 A. Such a feature makes the output stage suitable for driving light sources 1116 with the same high resolution in the 200 mA-2 A range. In other embodiments, different digital input signals may be provided having different resolutions and ranges, and different current mirror ratios may be established.

To minimize the power required by the auxiliary circuitry and also establishing the light source (LED) driver easier to bias, the mirroring ratio has been maximized up to 200. In other embodiments other mirroring ratios may be configured which are greater than or less than a ratio of 200. By mirroring at a high ratio, such as 50 or greater, the power consumption is reduced, yet the dynamic range of the output is greatly increased.

The accuracy in the mirroring of the current is achieved using the operational amplifier G1 1124 which equalizes the drains of the input and output mirror MOSFETs 1108, 1112. This dynamically establishes the drains of these devices at the save voltage or current. This also provides high output impedance, as is preferred for driving commonly available light sources including but not limited to LEDs and lasers.

The current driver embodiments disclosed herein have numerous advantages over the prior art. One such advantage is that using MOSFETs in the linear region opens the possibility to reduce the output headroom and reduce the power dissipation. For example, in one example driver configuration, the output MOSFET operates at only 100 mV when driving 2 A. This is a significant reduction in power consumption as compared to prior art power consumption for prior art designs. In addition, for lower current the output headroom can be proportionally reduced down to about 30 mV. In addition, a much higher dynamic range can be achieved than with prior art solutions.

Another advantage is that no external components are required other than a low power current setting resistor. Hence, in one configuration all of the elements of the system are part of a single IC. In one configuration all of the elements of the system are part of a single IC except for a low power current setting resistor. In one embodiment, this resistor is part of or associated with the DAC 1132, or is part of a circuit that sets the reference current for this DAC. In one exemplary configuration, the DAC 1132 may be internally configured with a resistor that is part of a separate current mirror. This resistor may be external. A reference or fixed voltage is presented across the resistor to generate a reference current. The control inputs 1140, 1150 to the DAC 1132 control the mirror factor or ratio of the DAC current mirror to mirror up the reference current based on the inputs 1140, 1150. This is one example method and apparatus for establishing and controlling the $I_{DAC}$ current.

Figure 4:
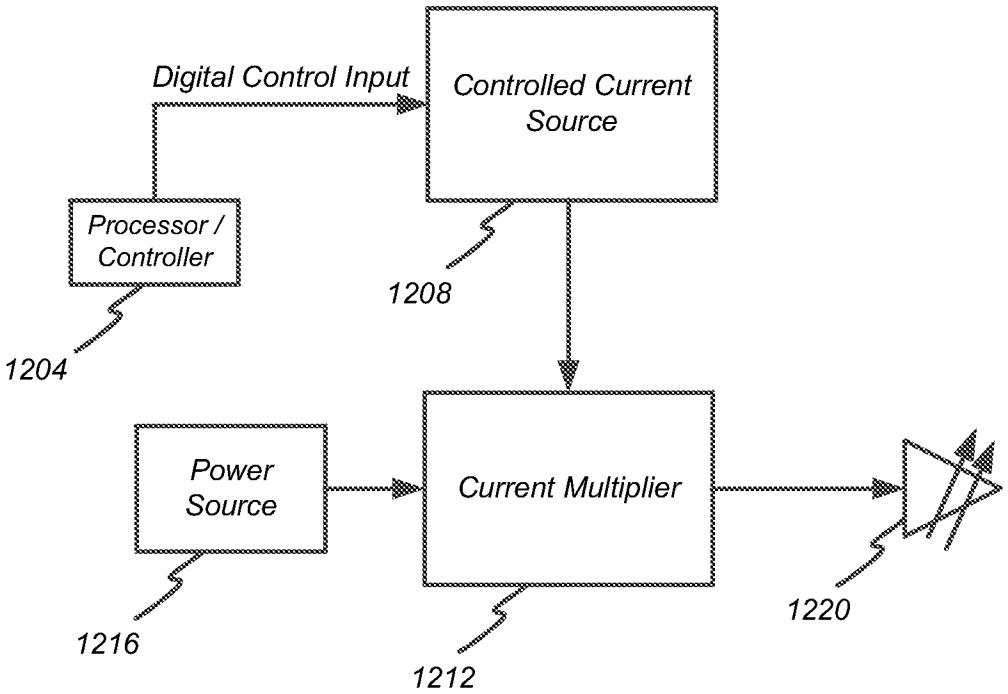
FIG. 4 illustrates an example block diagram of a digitally controlled current driver.

FIG. 4 illustrates a block diagram of current driver as disclosed herein. This is but one exemplary block diagram and other configurations are contemplated. A processor or controller 1204 generates a digital code representing the brightness or intensity of light to be output from a light source 1220. In other embodiments the digital control input may represent another value besides a brightness or light intensity. The processor 1204 may comprise any type processor or controller including but not limited to a processor, control logic, ASIC, digital logic, digital signal processor, general purpose processor, switch, multiplexer, etc or any other device capable of performing as described herein. As is understood, the processor 1204 may include or connect to memory (not shown), which is common in the art. Machine readable code may be stored on the memory and the machine readable code is executable by the processor to perform one or more operations on the software and data which is presented to the processor or memory for processing. The data processed by the processor may be from any source such as on-line, memory, CD-ROM, over the air signal, or any other source.

The processor or controller 1204 provides a digital or analog control signal to a controlled current source 1208. In one embodiment the controlled current source comprises a digital to analog converter. Responsive to the control input, which in this embodiment is a digital signal, the controlled source 1208 generates a current that is proportional or related to the control input. The current may be amplified in the source or when generated or this may occur in the next processing block. This generated current is provided to a current multiplier 1212. The current multiplier 1212 is connected to a power source 1216 and is configured to increase the magnitude or replicate and amplify the current from the controlled current source 1208. In one embodiment the current multiplier 1212 comprises a current mirror.

The output of the current multiplier 1212 is presented to the light source 1220 as the drive signal. The signal may be presented to one or more light sources. Responsive to the drive signal from the current multiplier 1212, the light source 1220 generates the light signal used in the projection system. The light source may comprise a LED, laser, or any other type light source.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

While various embodiments of the invention have been described, it will be apparent to those of ordinary skill in the art that many more embodiments and implementations are possible that are within the scope of this invention. In addition, the various features, elements, and embodiments described herein may be claimed or combined in any combination or arrangement.

What is claimed is:

1. A current driver circuit, comprising:

a digital to analog converter configured to receive a time varying digital value representing a light intensity and convert the digital value to an time varying analog current signal;

a current mirror formed by a first transistor, in a first current mirror leg, having a first transistor control input and a second transistor, in a second current mirror leg, having a second transistor control input, the first transistor control input and the second transistor control input connected to form a control node, the current mirror configured to create a current mirror output which is equal to or larger than the analog current signal based on a ratio of the current mirror to thereby created a modified analog current signal;

an amplifier having an input and an output, the amplifier configured to:

receive the time varying analog current signal;

amplify the time varying analog current signal thereby creating an amplified analog current signal, the amplified analog current signal configured to increase the speed of the current mirror in response to changes in magnitude in the time varying analog current signal; and outputting the amplified analog current signal to the control node;

a balancing amplifier having a first input connected to a drain node of the first transistor and a second input connected to a drain node the second transistor, the balancing amplifier configured to process a signal on the drain node of the first transistor and a signal on the drain node of the second transistor to generate a balancing signal that is provided the first leg of the current mirror to balance the drain nodes of the first transistor and second transistor within the current mirror to establish accuracy in the current mirror output;

a light source configured to receive the current mirror output, and responsive to the current mirror output generate a light signal, the light signal having an intensity controlled by and proportional to the digital value.

2. The current driver of claim 1 further comprising an equalizing amplifier configured to equalize drain terminals of an input device and an output device in the current mirror which establishes the drains of the input device and the output device at the same or generally the same voltage or current.

3. The current driver of claim 1 further comprising a processor configured to generate or obtain the digital value from image data.

4. The current driver of claim 1 wherein the digital to analog converter has a 10 bit resolution and a 6 bit range.

5. A method for establishing a light signal having an intensity determined by a digital value comprising:

receiving image data;

processing the image data to determine the intensity:

generating a digital value representing the intensity;

processing the digital value to generate a first current that is proportional to the digital value, the first current varying with time based on the intensity;

processing the first current with a current mirror, having a first transistor in a first current mirror leg and a second transistor in a second current mirror leg, to generate a second current, a magnitude of the second current being greater than a magnitude of the first current;

amplifying the first current with an amplifier to generate a time varying supplemental current, the time varying supplemental current presented to a control node of the current mirror as part of the processing of the first current to generate the second current to thereby increase transition speed when generating the second current in response to a time varying change in the digital value;

balancing a first drain node of the first transistor to a second drain node of the second transistor to increase current mirror accuracy by:

accepting a first drain node signal from the first transistor at a first input terminal of a balancing amplifier;

accepting a second drain node signal from the second transistor at a second input terminal of the balancing amplifier;

outputting the difference between the first drain node signal and the second drain node signal to the first current mirror leg to balance the signals at the first drain node and the second drain node;

presenting the second current to a light source; and generating the light signal with the light source, the intensity of the light signal proportional to the digital value.

6. The method from claim 5 wherein the processing the digital value is performed by a digital to analog converter.

7. The method from claim 5 wherein the current mirror has a current mirror ratio of greater than 1:50.

8. The method from claim 5 wherein the light source comprises a laser or LED.

9. The method from claim 5 further comprising presenting the amplified first current to a gate node, the gate node formed as a connection point between two or more gate terminals in a current mirror.

10. A current driver and light source, the current driver configured to provide a driver current to a light source used in an a projector system, the current driver comprising:

a controlled current source configured to receive a time varying digital control input from a processor to generate a time varying first current;

an amplifier having an input and an output, the input configured to received and amplify the time varying first current to generate an amplified time varying first current;

a current multiplier, having a first leg and a second leg, configure to receive the amplified time varying first current and power from a power source, the current multiplier outputting a second current wherein the amplified time varying first current speeds operation of the current multiplier;

a balancing amplifier having a first input terminal connected to the second leg and a second input terminal connected to the first leg, the balancing amplifier configured to balance the signal in the first leg and the second leg to improve accuracy of the current multiplier; and a light source configured to receive the second current, and responsive to the second current, generate a light signal having an intensity directly proportional to the digital control input.

11. The current driver and light source of claim 10 wherein the current multiplier comprises a current mirror.

12. The current driver and light source of claim 11 further comprising an amplifier configured to amplify the first current and present the amplified first current to a gate node in the current mirror to increase responsiveness of the current driver.

13. The current driver and light source of claim 11 further comprising an amplifier and a transistor, the amplifier having an output connected to a gate node of the transistor and first input configured to receive the second current and a second input configured to receive at least a portion of the first current, the amplifier configured to equalizes drain nodes of the current mirror.

14. The current driver and light source of claim 10 wherein the controlled current source comprises a digital to analog converter.

15. The current driver and light source of claim 10 wherein the digital to analog converter is a current or current source digital to analog converter.

16. The current driver and light source of claim 10 further comprising a processor configured to generate or receive image data, which the processor uses to form the digital control input.

* * * * *